US007108032B1

(12) United States Patent
Whiteford et al.

(10) Patent No.: US 7,108,032 B1
(45) Date of Patent: Sep. 19, 2006

(54) ACCORDION STYLE CARD HOLDER

(75) Inventors: Russell E. Whiteford, Chicopee, MA (US); Laura Drnek, Chicopee, MA (US)

(73) Assignee: Buxton Acquisition Co., LLC, Chicopee, MA (US)

( * ) Notice: Subject to any disclaimer, the term of this patent is extended or adjusted under 35 U.S.C. 154(b) by 420 days.

(21) Appl. No.: 10/735,060

(22) Filed: Dec. 15, 2003

(51) Int. Cl.
*A45C 1/06* (2006.01)
*A45C 11/18* (2006.01)

(52) U.S. Cl. ..... 150/149; 206/37; 206/39.5

(58) Field of Classification Search ..... 159/112, 159/131, 132, 135–153; 206/37, 39.5, 425, 206/810, 38; 190/111, 903
See application file for complete search history.

(56) References Cited

U.S. PATENT DOCUMENTS

| | | | | |
|---|---|---|---|---|
| 539,248 | A * | 5/1895 | Cano | 150/136 |
| 601,051 | A * | 3/1898 | Cano | 150/136 |
| 697,751 | A * | 4/1902 | Rasmussen | 150/112 |
| 2,477,840 | A | 8/1949 | Vasilas | |
| 2,577,670 | A * | 12/1951 | Adams | 190/111 |
| 2,727,549 | A * | 12/1955 | Knee | 150/133 |
| 3,483,909 | A | 12/1969 | Osher et al. | |
| 4,974,652 | A * | 12/1990 | Lemler | 150/147 |
| 5,080,223 | A | 1/1992 | Mitsuyama | |
| D332,866 | S | 2/1993 | Kopel et al. | |
| D344,181 | S | 2/1994 | Guzman-Rosario | |
| D376,257 | S | 12/1996 | Broussalian | |
| 5,595,401 | A | 1/1997 | Exline et al. | |
| 5,800,659 | A | 9/1998 | Exline et al. | |
| D403,915 | S | 1/1999 | Temple et al. | |
| 5,913,349 | A | 6/1999 | Festus | |
| 5,913,539 | A | 6/1999 | Exline et al. | |
| D434,899 | S | 12/2000 | Kojoori | |
| 6,155,410 | A | 12/2000 | Davis | |
| D441,527 | S * | 5/2001 | Hersh et al. | D3/233 |
| 6,558,062 | B1 * | 5/2003 | Wyant et al. | 402/73 |
| 6,575,273 | B1 * | 6/2003 | Bergkvist et al. | 190/114 |
| 6,634,493 | B1 | 10/2003 | Exline | |
| 6,837,368 | B1 * | 1/2005 | Chang | 206/232 |
| 2001/0027834 | A1 * | 10/2001 | Southwick | 150/108 |
| 2002/0060166 | A1 * | 5/2002 | Johnson | 206/425 |
| 2004/0118731 | A1 * | 6/2004 | Zivic et al. | 206/425 |

FOREIGN PATENT DOCUMENTS

| | | | |
|---|---|---|---|
| EP | 0281848 | A2 * | 9/1988 |
| JP | 11266917 | A * | 10/1999 |
| JP | 2000308510 | A * | 11/2000 |

* cited by examiner

*Primary Examiner*—Sue A. Weaver
(74) *Attorney, Agent, or Firm*—Deborah A. Basile; Karen K. Chadwell

(57) ABSTRACT

Disclosed herein is a holder comprising a first compartment comprising: a first front side and a first back side each comprising a first exterior and a first interior surface; a first pocket secured to the first interior surface of the first front side and to the first interior surface of the first back side; and a first zipper element joining the first front side and the first back side of the first compartment. The holder further comprises a second compartment comprising: a second front side and a second back side each comprising a second exterior and a second interior surface; an accordion file secured to the second interior surface of the second front side and to the second interior surface of the second back side; and a second zipper element joining the second front side and the second back side of the second compartment.

1 Claim, 5 Drawing Sheets

ACCORDION STYLE CARD HOLDER

BACKGROUND OF THE INVENTION

1. Field of the Invention

The present invention relates to an article for holding and retaining a variety of personal items. More particularly, this invention relates to a holder comprising individualized compartments, wherein at least one compartment is formed to hold coins and at least another compartment is formed to hold credit cards, automatic teller machine ("ATM") cards, identification cards, monetary bills, photographs, and the like, wherein the holder can hold and retain items securely while simultaneously allowing easy visibility of and access to the contents of the holder.

2. Description of the Prior Art

The prior art teaches a variety of articles used to retain a user's personal items in a variety of fashions. For example, U.S. Pat. No. 2,477,840 to Vasilas teaches a pocket wallet comprising transparent envelopes, a bill fold, and a coin envelope. The exterior of the wallet comprises a window such that a portion of the transparent window closest to the exterior of the wallet may be viewed. The transparent envelopes are hinged onto a flexible hinge forming strip, and are thereby secured onto the wallet. The bill fold is also hinged onto the flexible hinge forming strip and is positioned directly next to the transparent envelopes. The bill fold comprises a top portion that is attached to a bottom portion by means of a button fastener. Attached to the bill fold and opposite to the transparent envelopes is a coin envelope. The coin envelope may be opened and closed by a snap button fastener. The pocket wallet is zipped closed, wherein the zipper engages with teeth located on three of the four sides of the wallet.

U.S. Pat. No. 2,477,840 has several disadvantages. For example, in order to access either the paper currency or the coins, a user must first open the wallet, and then open up either the bill fold component or the coin envelope component. Additionally, due to the construction of the wallet, the bill fold component and coin envelope are unnecessarily constricted in the amount of currency that the wallet can hold. Also, the construction of the wallet makes it difficult for a user to differentiate between the different types of currency and to maneuver in the small spaced opening allotted by the bill fold and coin envelope components.

D376,257 to Broussalian teaches several embodiments of an accordion style card holder. More particularly, D376,257 teaches a front cover attached to a back cover by means of a screw like mechanism. An accordion file is attached to the interior surfaces of the front and back covers by means of mounting surfaces attached to each of the two opposite ends of the accordion file. D376,257 is limited, however, in that it holds only cards, and does not contemplate the holding and retention of other items, such as coins.

D332,866 to Kopel et al. teaches a wallet comprising three parts: a top part, a middle part, and a bottom part. The top part comprises an interior side comprising a transparent window in the center portion of the interior side and a Velcro fastening means on the top center of the interior side. The middle part continuously joins the top and bottom parts. The middle part comprises a transparent window and a zipper portion on its exterior surface. On its interior surface, the middle part comprises three slots formed to hold identification cards, credit cards, etc. The interior surface of the middle part further comprises a zippered section. The bottom part comprises a Velcro receiving part on its exterior surface, wherein the Velcro fastening means from the top part is positioned on the Velcro receiving part on the bottom part to secure the wallet in a closed position. The interior surface of the bottom part of the wallet comprises two pockets and a key ring. The bottom part and the middle part (excluding the zipper portion of the middle part) can be secured together by means of a zipper. D332,866, however, fails to teach a wallet wherein a user has easy access to both coins and to other personal items.

Therefore, what is currently needed in the art is a holder capable of holding a wide variety of materials, such as coins, paper currency, identification cards, credit cards, ATM cards, and the like, wherein access to these materials is unrestricted. Furthermore, the art requires a holder wherein a user can readily assess the types of materials contained in the holder and can readily insert and remove the materials, wherein the holder securely retains the materials, and wherein the holder is not overly cumbersome to a user.

SUMMARY OF THE INVENTION

The above-discussed and other drawbacks and deficiencies of the prior art are overcome or alleviated by a holder comprising a first compartment comprising: a first front side and a first back side each comprising a first exterior and a first interior surface; a first pocket secured to the first interior surface of the first front side and to the first interior surface of the first back side; and a first zipper element joining the first front side and the first back side of the first compartment. The holder further comprises a second compartment comprising: a second front side and a second back side each comprising a second exterior and a second interior surface; an accordion file secured to the second interior surface of the second front side and to the second interior surface of the second back side; and a second zipper element joining the second front side and the second back side of the second compartment.

DETAILED DESCRIPTION OF THE INVENTION

In general, disclosed herein is a holder especially adapted to securely hold a user's personal items while simultaneously allowing a user to readily view and remove items from the holder. Additionally, due to the positioning and configuration of the various elements forming the holder, the holder has a relatively large carrying capacity and can still be of a compact form such that a user can easily store the holder in a convenient place, such as, for example, a purse, a billfold, or a pant or a coat pocket. More particularly, the holder comprises a first compartment preferably adapted to securely hold coins such that a user can readily identify, select, and remove individual coins among the variously assorted coins contained in the first compartment. The holder further comprises a second compartment adapted to securely hold various types of personal articles, wherein such personal articles may include, for example, credit cards, ATM cards, photographs, paper currency, identification cards, and the like.

The holder is more particularly described with reference to FIGS. 1–6. However, these figures are in no way to be construed as limiting to the present invention as variations and modifications to the figures are contemplated herein.

Figure 1:
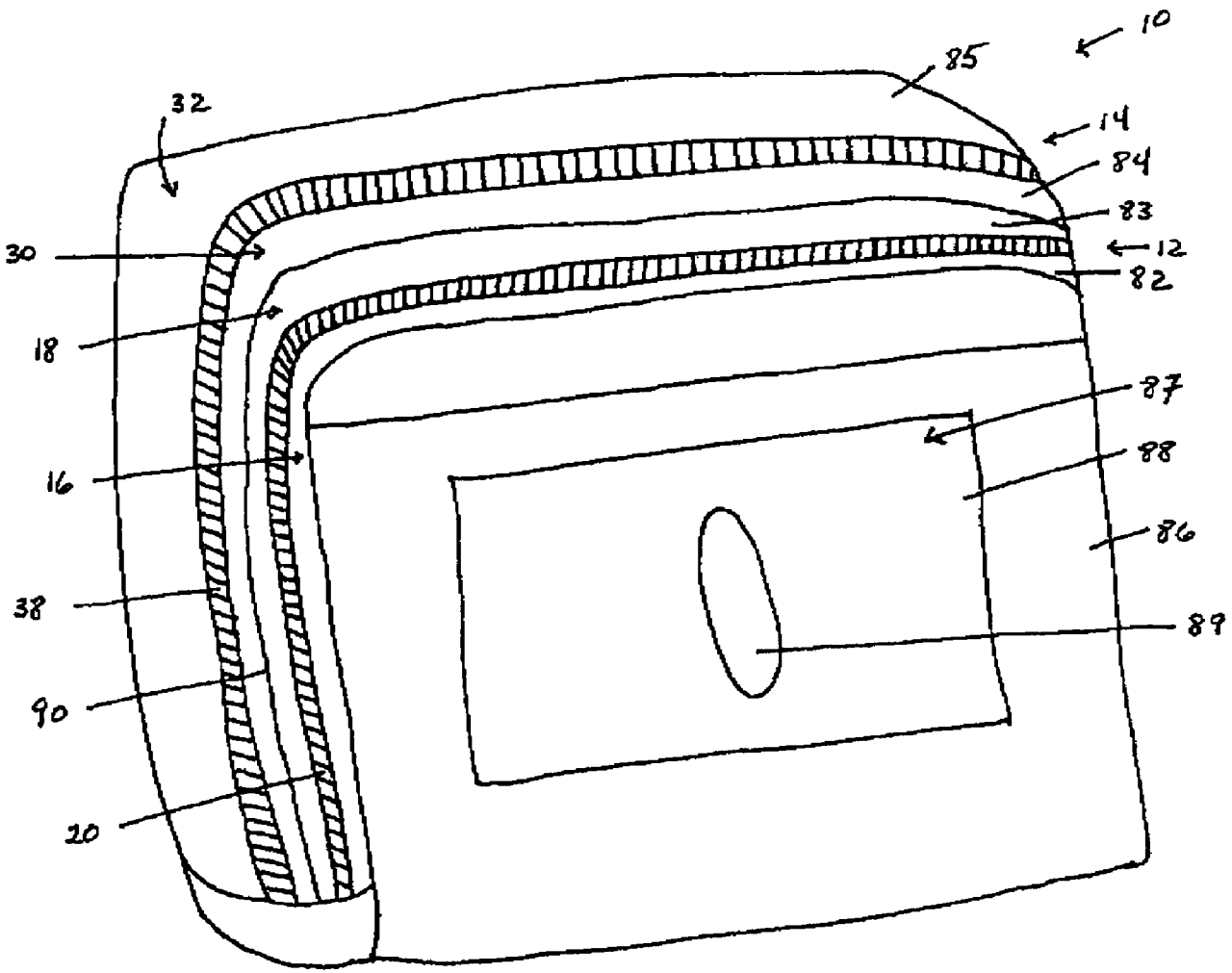
FIG. 1 is a schematic depicting a front elevational view of an exemplary holder.
Figure 2:
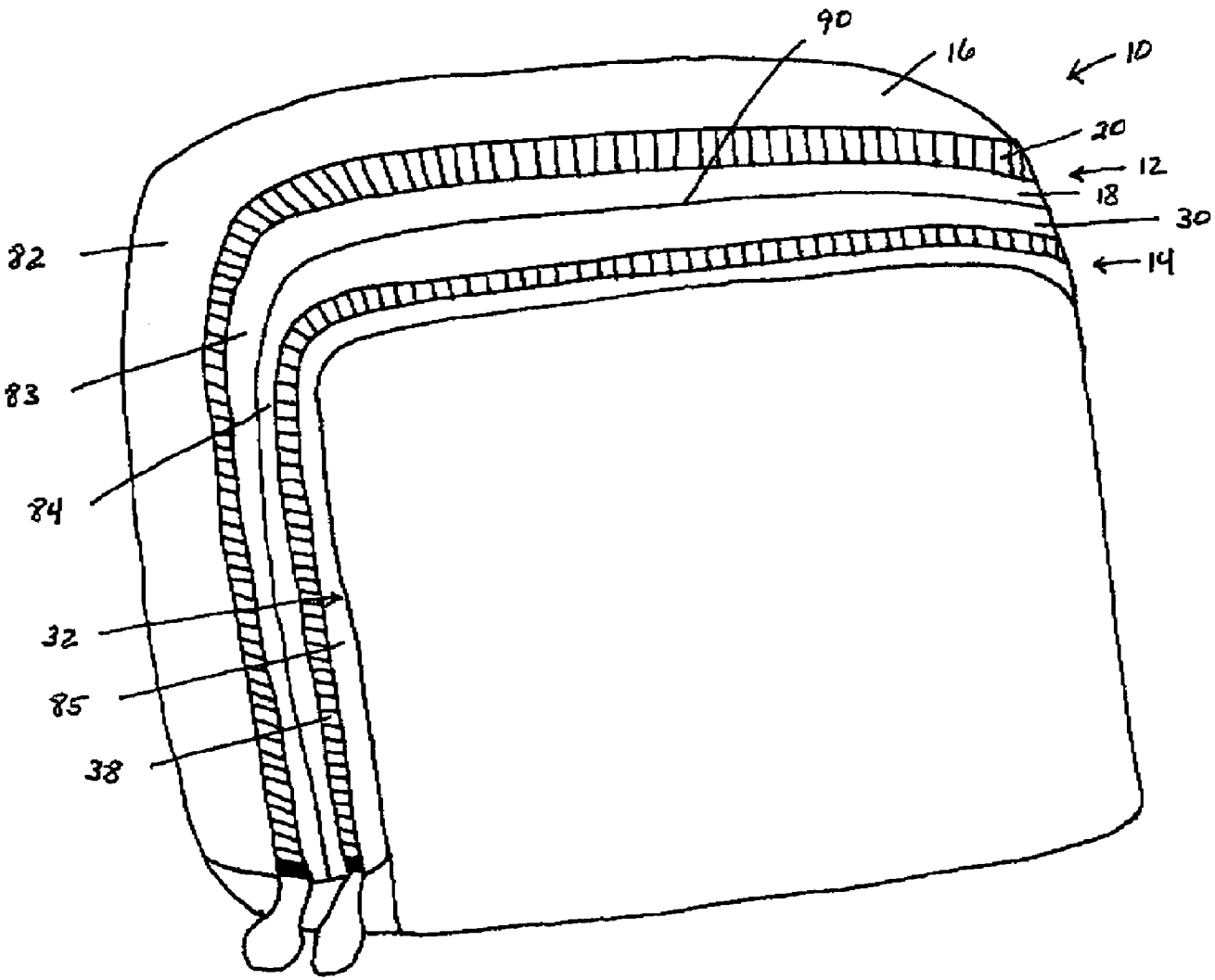
FIG. 2 is a schematic depicting a back elevational view of an exemplary holder.
Figure 3:
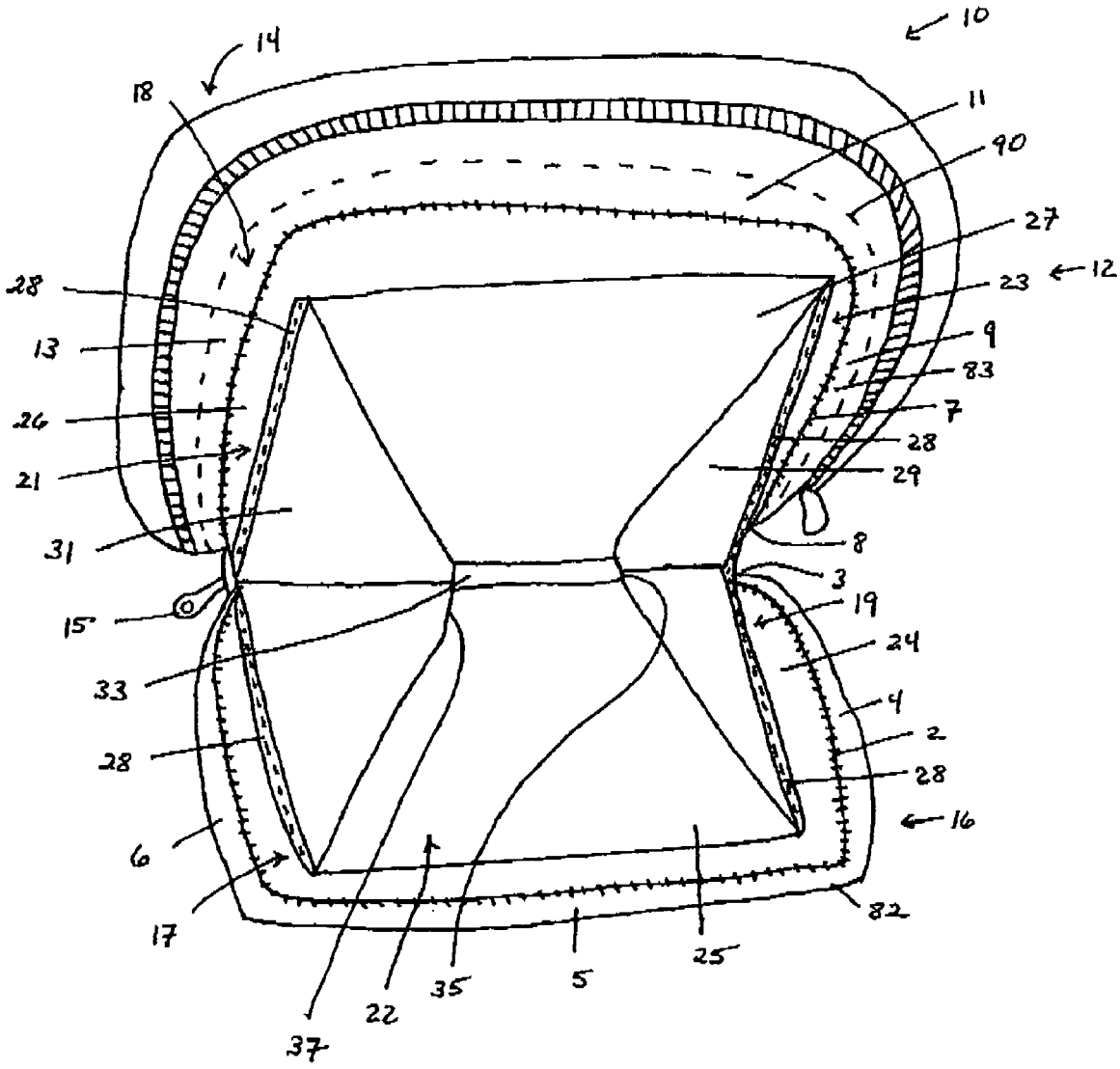
FIG. 3 is a schematic depicting an elevational view of an exemplary first compartment in an open position.

Referring to FIGS. 1–4, a holder 10 comprises a first compartment 12 joined to a second compartment 14. First compartment 12 comprises a first compartment front side 16 joined to a first compartment back side 18 by means of a first compartment zipper element 20. As shown in FIG. 3, for example, the first compartment zipper element comprises a first row of teeth 2 that extends from a point on a bottom surface 3 of first compartment front side 16, continues upwards along a proximal lateral edge 4 of first compartment front side 16, continues along a top side 5 of first compartment front side 16, continues downwards along a distal lateral edge 6 of first compartment front side 16, and terminates at another point on bottom surface 3 of first compartment front side 16. Similarly, the first compartment zipper element comprises a second row of teeth 7 that extends from a point on a bottom surface 8 of first compartment back side 18, continues upwards along a proximal lateral edge 9 of first compartment back side 18, continues along a top side 11 of first compartment back side 18, continues downwards along a distal lateral edge 13 of first compartment back side 18, and terminates at another point on bottom surface 8 of first compartment back side 18. First and second rows of teeth 2,7 are interlocked by means of a sliding tab 15.

Referring to FIG. 3, first compartment 12 further comprises a pocket 22 attached to interior surfaces 24, 26 of the first compartment front and back sides 16, 18 respectively. Pocket 22 is preferably shaped, dimensioned, and attached to interior surfaces 24, 26 such that pocket 22 is collapsible, i.e., when first compartment 12 is opened, e.g., unzipped, pocket 22 expands when first compartment front side 16 and first compartment back side 18 are moved away from each other, and contracts when first compartment front side 16 and first compartment back side 18 are moved towards each other.

As shown in FIG. 3, in a preferred embodiment, pocket 22 comprises a gusset like structure. Here, pocket 22 comprises a front insert 25 joined to a rear insert 27 by a proximal side insert 29, a distal side insert 31, and a floor element 33. Floor element 33 may be continuously formed with the front and rear inserts 25, 27. Proximal and distal side inserts 29, 31 each create an inverted fold or bend 35, 37 respectively such that side inserts 29, 31 comprise a V like structure, wherein the apex of the V points towards the interior of holder 10. Bends 35, 37 create flexibility in pocket 22 in that bends 35, 37 collapse pocket 22 when first compartment 12 is closed, e.g., zipped, and expand pocket 22 when first compartment front side 16 is moved away from first compartment back side 18 when first compartment 12 is opened, e.g., unzipped. The two end points of the V like structure are preferably joined to the respective front and rear inserts.

Still referring to FIG. 3, in an exemplary embodiment pocket 22 comprises a plurality of side walls 28, wherein one of side walls 28 is attached to a distal portion 17 of interior surface 24, one of side walls 28 is attached to a proximal portion 19 of interior surface 24, one of side walls 28 is attached to a distal portion 21 of interior surface 26, and one of side walls 28 is attached to a proximal portion 23 of interior surface 26. Each of side walls 28 serves to reinforce the attachment of the front and rear inserts 25, 27 and the proximal and distal side inserts 29, 31 onto the interior surfaces 24, 26 of the respective first compartment front and back sides 16, 18. Preferably, each of side walls 28 is stitched to its corresponding portion of interior surface 24, 26.

Figure 4:
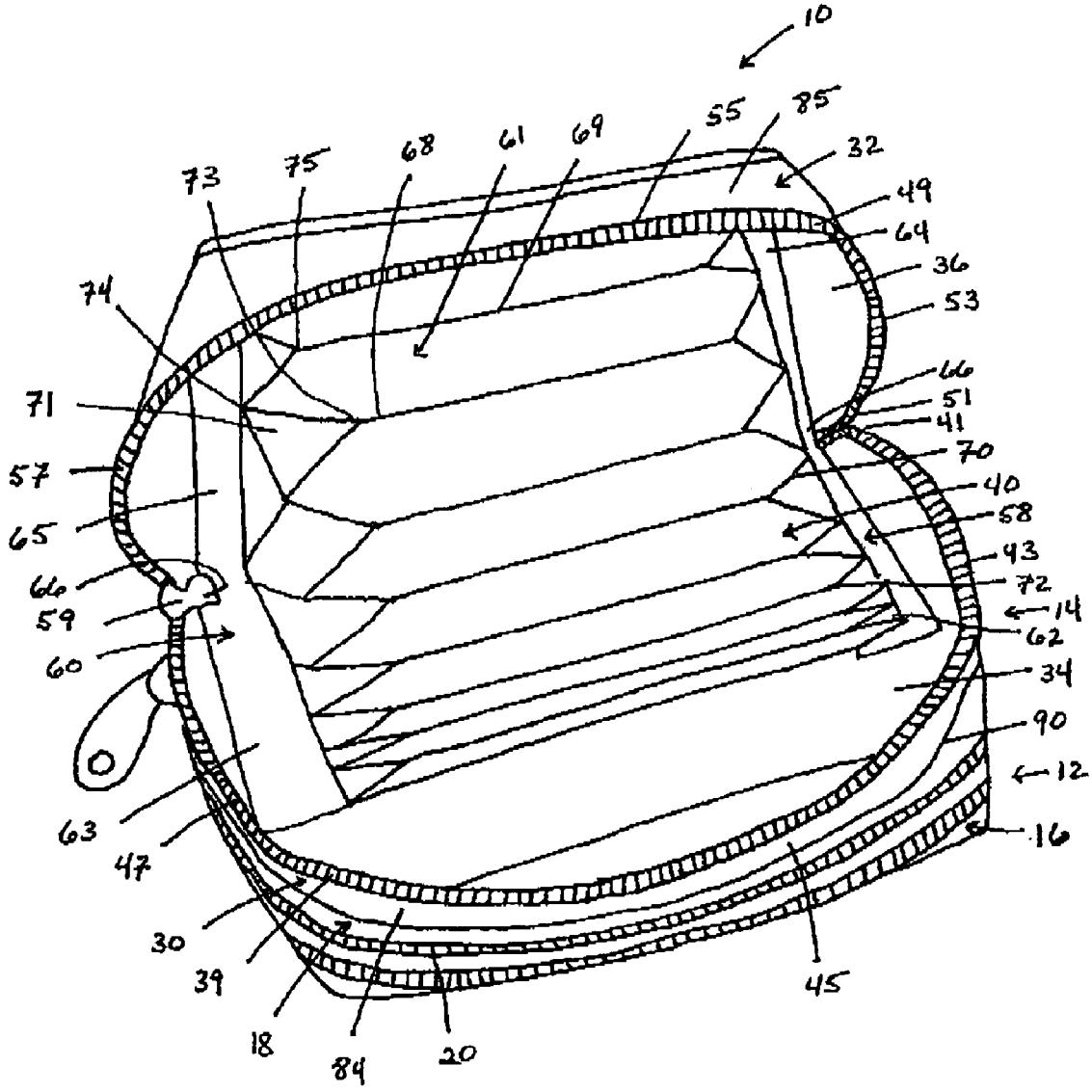
FIG. 4 is a schematic depicting an elevational view of an exemplary second compartment in an open position.

Referring to FIGS. 1, 2, and 4, second compartment 14 comprises a second compartment front side 30 and a second compartment back side 32, wherein each of second compartment front and back sides 30, 32 comprises a respective interior surface 34, 36. Second compartment front and back sides 30, 32 are joined together by means of a second compartment zipper element 38.

As shown in FIG. 4, for example, second compartment zipper element comprises a first row of teeth 39 that extends from a point on a bottom surface 41 of second compartment front side 30, continues upwards along a proximal lateral edge 43 of second compartment front side 30, continues along a top side 45 of second compartment front side 30, continues downwards along a distal lateral edge 47 of second compartment front side 30, and terminates at a point on bottom surface 41 of second compartment front side 30. Similarly, the second compartment zipper element comprises a second row of teeth 49 that extends from a point on a bottom surface 51 of second compartment back side 32, continues upwards along a proximal lateral edge 53 of second compartment back side 32, continues along a top side 55 of second compartment back side 32, continues downwards along a distal lateral edge 57 of second compartment back side 32, and terminates at a point on bottom surface 51 of second compartment back side 32. First and second rows of teeth 39, 49 are interlocked by means of a sliding tab 59.

Still referring to FIG. 4, second compartment 14 further comprises an accordion file 40. In an exemplary embodiment, accordion file 40 comprises two attachment sites 58, 60, which connect a plurality of files 61 to interior surfaces 34, 36 of second compartment front and back sides 30, 32. Preferably, each of attachment sites 58, 60 comprises a first arm 62, 63 attached to a second arm 64, 65 by means of a connector 66. Connector 66 preferably extends along the length of holder 10, such that it connects bottom surface 41 of second compartment front side 30 with bottom surface 51 of second compartment back side 32.

As shown in FIG. 4, first arm 62 is attached to a proximal side of interior surface 34, and first arm 63 is attached to a distal side of interior surface 34. Second arm 64 is attached to a proximal side of interior surface 36, and second arm 65 is attached to a distal side of interior surface 36. Preferably attachment sites 58, 59 are sewn onto respective interior surfaces 34, 36.

Figure 5:
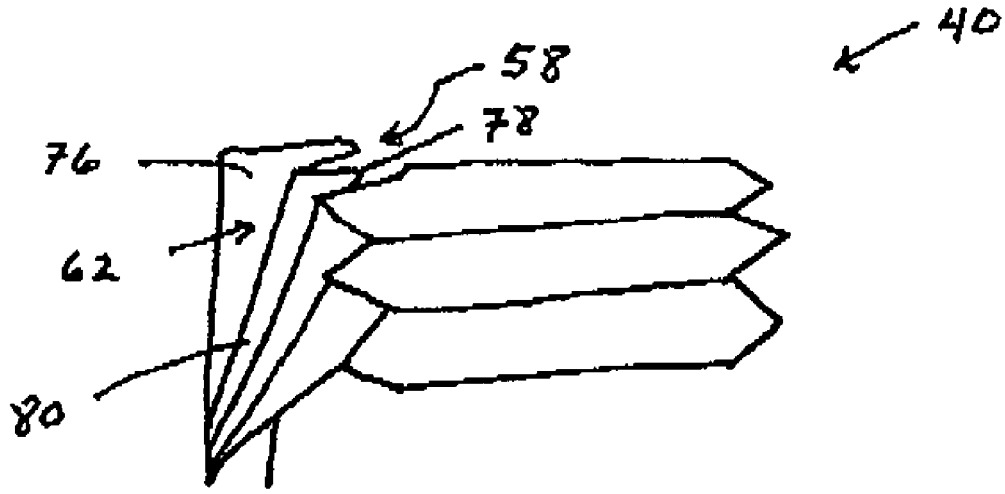
FIG. 5 is a schematic depicting a top view of an exemplary accordion file.
Figure 6:
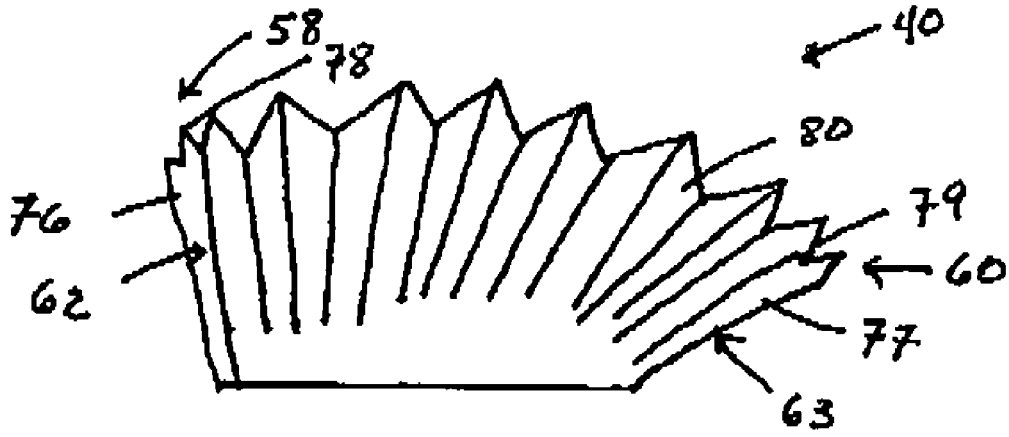
FIG. 6 is a schematic depicting a side view of the accordion file depicted in FIG. 5.

As previously stated, in an exemplary embodiment, attachment sites 58, 60 connect a plurality of files 61 to interior surfaces 34, 36 of second compartment 14. As shown in FIGS. 4–6, exemplary files forming plurality of files 61 each comprises a series of support members, wherein each support member is joined to a proximal lateral edge 70 and to a distal lateral edge 71.

Preferably proximal and distal edges 70, 71 each comprise a V-shaped top structure joined to a triangular side edge. Preferably, an apex 72, 73 of the V extends outwardly from the interior portion of holder 10. This arrangement provides for the placement of a wide variety of sizes of personal articles into the individual files, and, hence, enhances the carrying capacity of the holder. Preferably, each support member comprises a proximal end attached to an end point of the V shaped top structure and to a distal end attached to the opposite end point of the V-shaped top structure.

Adjacent support members may be connected by securing a first support member 69 onto an end point 74 of the V-shaped top structure, and by securing an adjacently positioned second support member 68 onto the opposite end point 75 of the same V-shaped top structure. Furthermore, the triangular side edges are in continuous association with each other, thereby further connecting plurality of files 61. Additionally, the series of support members is preferably fabricated from a single sheet of material such that, by a series of folds, individual support members may be formed. This creates a bottom floor defining a lower boundary such that personal articles do not fall from the bottom portion of the second compartment.

FIGS. 5 and 6 more clearly show a portion of accordion file 40. Referring to these figure, a portion of accordion file 40 is depicted as comprising first arms 62, 63 of attachment sites 58, 60. It is herein noted that the same explanation proceeding herein for the attachment of files applies to the attachment of files to the back side of the second compartment. First arms 62, 63 each comprises an anchoring element 76, 77 respectively, which attaches and secures accordion file 40 onto the interior surface of the front side of the second compartment. In a preferred embodiment, anchoring elements 76, 77 are secured onto the respective interior surface by means of stitching. A fold 78, 79 extends outwardly away from anchoring element 76, 77. Attached to each of fold 78, 79 is a continuous sheet of material 80 respectively, which is folded in a zigzag pattern (to form triangular side edges as described above) such that when material 80 is outstretched, it forms a fanlike or accordion pattern. Continuous sheet of material 80 may be stitched onto fold 76, 77, or may comprise the same material(s) as forms folds 76, 77 such that folds 76, 77 are continuous with the sheet of material 80.

Plurality of files 61 may comprise any number of individual files such that a user can readily locate, remove, and insert personal articles, without hindering closure of the holder. Preferably the plurality of files comprises up to about 20 files, with up to about 15 files more preferred, up to about 10 files even more preferred, and up to about 7 files especially preferred.

The holder may comprise a wide variety of materials, wherein the material is preferably selected to confer durability, weather resistance, and flexibility to the holder. The individual elements may comprise the same material(s) or different material(s) as the other elements forming the holder. For example, exterior surfaces 82, 83 of first compartment 12 and exterior surfaces 84, 85 of second compartment 14 preferably comprise vinyl, leather, and the like, wherein vinyl is preferred. Interior surfaces 24, 26 of first compartment 12 and interior surfaces 34, 36 of second compartment 14 may comprise vinyl, leather, and the like, wherein leather is preferred. Pocket 22 preferably comprises leather. Anchoring elements 76, 77 preferably comprise leather. Plurality of files 61 preferably comprises vinyl.

Referring to FIGS. 1–4, in another exemplary embodiment, first compartment back side 18 is joined to second compartment front side 30 (as shown by a groove 90). Although this connection may be accomplished by a variety of methods, in a preferred embodiment, interior surface 26 of first compartment back side 18 comprises a leather or a leather like material directly disposed onto a first vinyl backing. Similarly, interior surface 34 of second compartment front side 30 comprises a leather or a leather like material directly disposed onto a second vinyl backing. The four different layers may be stitched together such that the two vinyl backing layers may be in direct physical contact. It is noted, however, that the materials described as leather, leather like, or vinyl are not limited to these materials, but may comprise any material(s) capable of conferring the desired flexibility, durability, and weather resistance onto the holder.

Referring to FIGS. 1 and 2, another exemplary embodiment of holder 10 comprises a cover 86. Cover 86 preferably folds around first and second compartments 12, 14 such that cover 86 is preferably attached to an exterior surface 82 of first compartment 12 and to an exterior surface 85 of second compartment 14. Cover 86 preferably comprises leather, vinyl, and the like.

Additionally, cover 86 may comprise a pocket 87. Pocket 87 may be disposed on either a portion of cover 86 covering first compartment 12, or on a portion of cover 86 covering second compartment 14. Preferably pocket 87 comprises a window 88, wherein window 88 is preferably transparent. Preferably window 88 comprises a thumbhole 89 to assist a user in removing articles stored in pocket 87.

The holder described herein provides a convenient storage place for a user's personal articles in that it securely retains the items while allowing for visibility of the individual items contained in the holder. Additionally, the holder allows for increased ease in removing and inserting individual articles. That is, the positioning and configuration of the accordion files and the collapsible pocket improves both a user's maneuverability in the holder and allows for improved visibility. The positioning and geometrical configurations of the two separate compartments and their respective components also provides a mechanism whereby the holder has a large carrying capacity while still maintaining a compact shape to ease in carrying and storage of the holder.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. A holder comprising:

a first compartment comprising:

a first front side and a first back side, wherein each of the first front and back sides comprises:

a first exterior surface opposite to a first interior surface, wherein the first exterior and interior surfaces are bordered by:

a first top side opposite to a first bottom side; and a first proximal lateral side opposite to a first distal lateral side, wherein the first proximal and first distal lateral sides join the first top side to the first bottom side;

a first pocket secured to the first interior surface of the first front side and to the first interior surface of the first back side, wherein the first pocket is collapsible and wherein the first pocket comprises a front insert joined to a rear insert by a proximal side insert and a distal side insert, wherein the proximal and distal side inserts are opposite to each other, and further wherein each of the proximal and distal side inserts comprises a V like shape wherein an apex of the V points towards an interior of the holder, and further wherein the apex is between the front and rear inserts, and wherein the first pocket further comprises a plurality of side walls attached to the interior surfaces of the first front and back sides, and wherein the front insert, rear insert, proximal side insert, and distal side insert are attached to the plurality of side walls; and a first zipper element joining the first front side to the first back side; and a second compartment comprising:

a second front side opposite to a second back side, wherein each of the second front and back sides comprises:

a second exterior surface opposite to a second interior surface, wherein said second exterior and interior surfaces are bordered by:

a second top side opposite to a second bottom side; a second proximal lateral side opposite to a second distal lateral side, wherein the second proximal and distal lateral sides join the second top side to the second bottom side;

an accordion file secured to the second interior surface of the second front side and to the second interior surface of the second back side; and a second zipper element joining the second front side to the second back side of the second compartment;

wherein the first and second compartments are joined together.

* * * * *